US007622713B2

(12) United States Patent
Quarmby et al.

(10) Patent No.: US 7,622,713 B2
(45) Date of Patent: Nov. 24, 2009

(54) METHOD AND APPARATUS FOR NORMALIZING PERFORMANCE OF AN ELECTRON SOURCE

(75) Inventors: Scott T. Quarmby, Round Rock, TX (US); George B. Guckenberger, Austin, TX (US); Edward B. McCauley, Cedar Park, TX (US)

(73) Assignee: Thermo Finnigan LLC, San Jose, CA (US)

( * ) Notice: Subject to any disclaimer, the term of this patent is extended or adjusted under 35 U.S.C. 154(b) by 102 days.

(21) Appl. No.: 12/026,489

(22) Filed: Feb. 5, 2008

(65) Prior Publication Data

US 2009/0194680 A1 Aug. 6, 2009

(51) Int. Cl.
*H01J 49/10* (2006.01)
*H01J 49/16* (2006.01)
*H01J 49/00* (2006.01)

(52) U.S. Cl. ..... 250/288; 250/286; 250/281; 250/282; 250/423 R; 250/427; 250/396 R; 315/111.81

(58) Field of Classification Search ..... 250/288, 250/286, 281, 282, 423 R, 427, 396 R; 315/111.81
See application file for complete search history.

(56) References Cited

U.S. PATENT DOCUMENTS 3,510,647 A 5/1970 Wood
3,823,315 A 7/1974 Mosharrafa
3,920,986 A 11/1975 Fies, Jr.
3,946,229 A 3/1976 Moseman, Jr. et al.
4,847,493 A 7/1989 Sodal et al.
4,851,673 A 7/1989 Izumi et al.
5,545,895 A 8/1996 Wright et al.
7,047,144 B2 5/2006 Steiner
7,053,365 B2 5/2006 Shimomura
7,323,682 B2 * 1/2008 McCauley et al. ..... 250/287
2009/0014667 A1 * 1/2009 Hahto et al. ..... 250/492.21
2009/0032702 A1 * 2/2009 Quarmby et al. ..... 250/288

OTHER PUBLICATIONS

"Shimadzu—GCMS-QP2010/2010s iSolutions for GC/MS," Brochure, Rev Jun. 2005, p. 4, (2002).

* cited by examiner

*Primary Examiner*—Nikita Wells
(74) *Attorney, Agent, or Firm*—Haynes & Boone, LLP; Charles B. Katz

(57) ABSTRACT

A method for operating a mass spectrometer includes determining a first performance characteristic while operating the mass spectrometer with a first electron emitter, storing first information relating to the first performance characteristic, determining a second performance characteristic while operating the mass spectrometer with a second electron emitter, storing second information relating to the second performance characteristic, and thereafter switching from operation using the first electron emitter to operation using the second electron emitter. The switching includes using the first and second information to normalize performance of the second electron emitter after the switching relative to performance of the first electron emitter before the switching.

22 Claims, 2 Drawing Sheets

METHOD AND APPARATUS FOR NORMALIZING PERFORMANCE OF AN ELECTRON SOURCE

TECHNICAL FIELD

This invention relates in general to mass spectrometers and, more particularly, to a mass spectrometer with an ion source having multiple filaments.

BACKGROUND

Existing mass spectrometers have an ion source that produces ions of a sample material. These ions are then processed by a mass analyzer which includes a mass detector. Some existing ion sources produce ions using a technique known as electron ionization (EI) and others using a technique known as chemical ionization (CI). In both EI and CI, an electron source is configured to selectively provide a stream of electrons to the ion volume. The electron source includes a filament that is energized to emit electrons for the stream. It is advantageous to provide a second filament. When one of the filaments burns out, an operator can continue running samples with the other filament. As such, the mass spectrometer is not rendered completely inoperative by a burned-out filament, and can continue operating with minimum disruption.

However, no two filaments are exactly the same. For example, each filament may produce a different ion intensity while the mass spectrometer is operating under the same operating conditions. The ion intensity can be as different as a factor of two. Differences can be caused by small variations in filament position, reflector position, filament alignment with the ion volume, filament composition, or other factors. Accordingly, the mass spectrometer is normally recalibrated when switching filaments to ensure that the mass spectrometer continues to generate accurate and consistent data when running samples with the other filament. However, recalibration is time consuming, and requires scrapping the sample run that was currently in progress before the burnout.

SUMMARY

One of the broader forms of the invention involves a method for operating a mass spectrometer that includes: determining a first performance characteristic while operating the mass spectrometer with a first electron emitter, storing first information relating to the first performance characteristic, determining a second performance characteristic while operating the mass spectrometer with a second electron emitter, storing second information relating to the second performance characteristic, and thereafter switching from operation using the first electron emitter to operation using the second electron emitter, the switching including using the first and second information to normalize performance of the second electron emitter after the switching relative to performance of the first electron emitter before the switching.

Another of the broader forms of the invention involves an apparatus including a mass spectrometer that includes: structure defining an ion volume, first and second electron emitters that can each selectively supply electrons to the ion volume, and a controller. The controller is configured to: determine a first performance characteristic while operating the mass spectrometer with the first electron emitter, store first information relating to the first performance characteristic, determine a second performance characteristic while operating the mass spectrometer with the second electron emitter, store second information relating to the second performance characteristic, and thereafter switch from operation using the first electron emitter to operation using the second electron emitter, including use of the first information and second information to normalize performance of the second electron emitter after the switch relative to performance of the first electron emitter before the switch.

DETAILED DESCRIPTION

Figure 1:
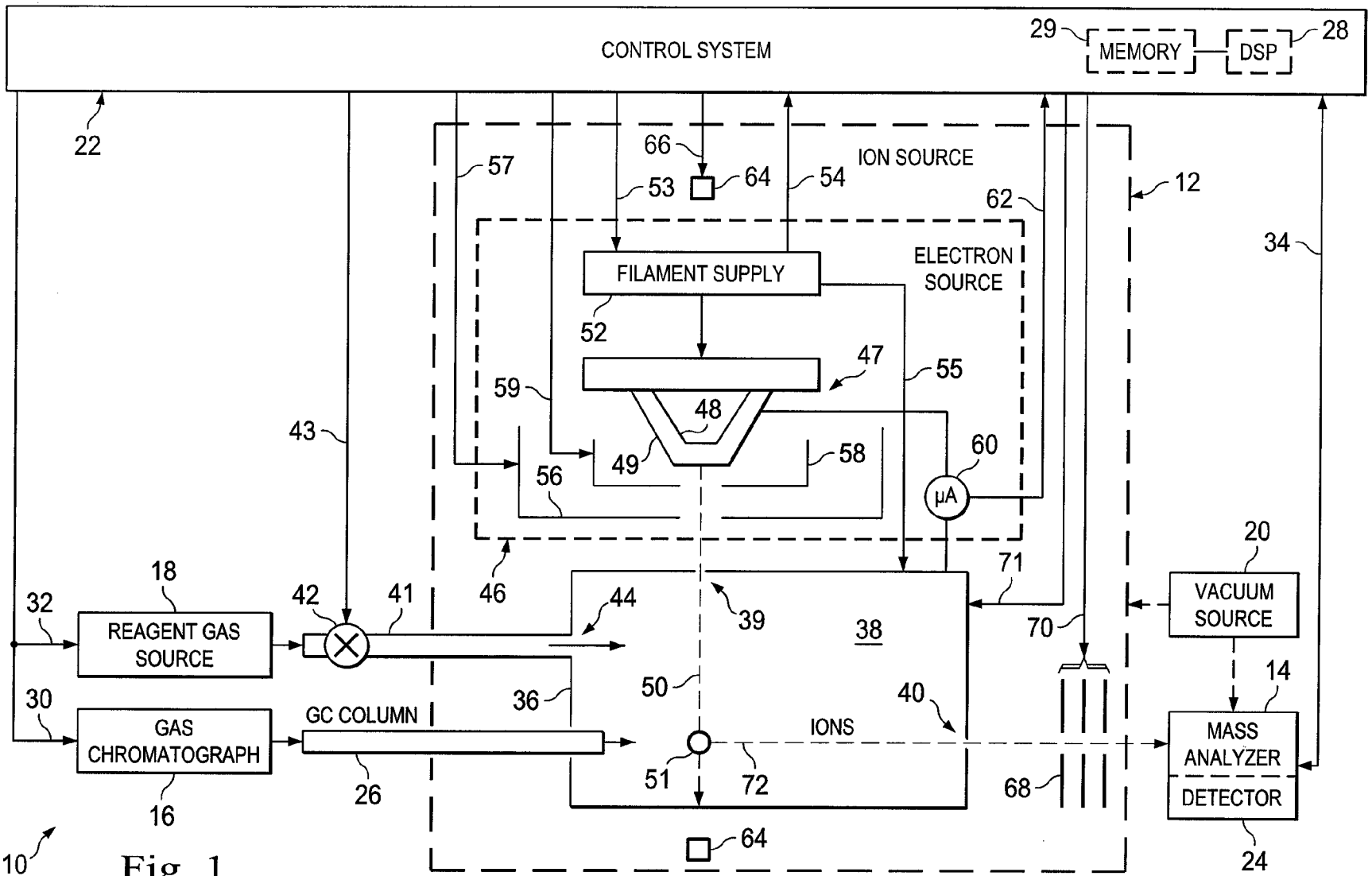
FIG. 1 is a block diagram of a mass spectrometer that embodies aspects of the present invention.

FIG. 1 is a block diagram of a mass spectrometer (MS) 10 that embodies aspects of the present invention. The mass spectrometer 10 includes an ion source 12, a mass analyzer 14, a gas chromatograph 16, a source 18 of a reagent gas, a vacuum source 20, and a control system 22. The disclosed mass spectrometer 10 is configured for chemical ionization (CI), but could alternatively be configured for electron ionization (EI).

The mass analyzer 14 is a type of device that is known in the art, and in fact could be any of a number of commercially-available devices. The mass analyzer 14 may include a not-illustrated device to separate ions based on their mass-to-charge ratios, examples of which include but are not limited to a quadrupole filter, a linear ion trap, a rectilinear ion trap, a three-dimensional ion trap, a cylindrical ion trap, a Fourier transform ion cyclotron resonance filter, an electrostatic ion trap, a Fourier transform electrostatic filter, a time-of-flight filter, a quadrupole time-of-flight filter, a hybrid analyzer, or a magnetic sector. Further, the mass analyzer 14 includes a detector 24 that can detect ions. The detector 24 generates an electrical signal that corresponds to an ion intensity (quantity of ions) detected by the detector, and the signal is transmitted to the control system 22 for processing. The detector 24 has a gain that varies in response to a gain control signal sent from the control system 22, in a manner discussed later.

The gas chromatograph 16 is also a known type of device, and could be any of a number of commercially-available devices. The gas chromatograph 16 serves as a source of particles of a sample material that are referred to as analytes. In particular, the gas chromatograph 16 outputs analytes that are atoms or molecules of the sample material in a gas phase. The sample analytes delivered by the gas chromatograph 16 travel to the ion source 12 through a gas chromatograph (GC) column 26 of a known type. For example, the GC column 26 may be a fused silica capillary tube of a type well known in the art. Alternatively, instead of the gas chromatograph 16 and GC column 26, the sample analytes may optionally be generated by a liquid chromatograph (LC) and delivered by an LC column.

The reagent gas source 18 is also a known type of device, and produces a flow of a reagent gas such as methane. The vacuum source 20 is a known type of system, and is operatively coupled to both the ion source 12 and the mass analyzer 14, in order to maintain a vacuum in interior regions during normal operation.

The control system 22 includes circuitry of a known type, and is operatively coupled to various other components of the mass spectrometer 10. In the disclosed embodiment, the control system 22 includes a digital signal processor (DSP) that is indicated diagrammatically at 28. The DSP 28 executes a software program that determines how the control system 22 controls other components of the mass spectrometer 10. The software program also processes data associated with analytical runs of a sample material. For example, the software program includes a scaling factor that scales an ion intensity detected by the detector 24, in a manner discussed later. The control system 22 further includes memory 29 for storing software programs, analytical data, and other information associated with the operation and functionality of the mass spectrometer 10. The DSP 28 could alternatively be a microcontroller, or some other form of digital processor. As another alternative, the DSP 28 could be replaced with a state machine or a hardwired circuit. The control system 22 includes an output 30 that controls the gas chromatograph 16 and an output 32 that controls the reagent gas source 18. The control system 22 further includes a line 34 that communicates with the mass analyzer 14 for transmitting and receiving data. In addition, the control system 22 includes other outputs that control various other components of the mass spectrometer 10, in a manner discussed later. It is to be understood that line 34 and the other lines to and from the controller may be provided by either a wired or a wireless transmission, or both.

The ion source 12 has therein an electrically conductive housing 36 with a chamber serving as an ion volume 38. The housing 36 has two openings 39 and 40 that provide communication between the ion volume 38 and the exterior of the housing. The opening 39 serves as an electron opening or an electron inlet port, and the opening 40 serves as an ion opening or an ion outlet port in a manner discussed herein. A gas supply conduit 41 extends from the reagent gas source 18 to the housing 36, and an electrically-operated valve 42 is provided along the conduit to control gas flow through the conduit. The valve 42 is controlled by an output 43 of the control system 22. The conduit 41 opens into the ion volume 38 through a gas inlet port 44. The end of the GC column 26 remote from the gas chromatograph 16 has an end portion that projects a short distance into the ion volume 38 through an opening in the housing 36.

The ion source 12 includes near the housing 36 an electron source 46. The electron source 46 includes a filament assembly 47 having two filaments 48 and 49 that serve as electron emitters, and that may be of the thermionic emitter type. Alternatively, instead of using thermionic emitters such as the filaments 48 and 49, the electron emitters may optionally be field emitters, such as electron discharge needles. The filaments 48 and 49 having generally hairpin configurations and are positioned in relative overlying relationship to each other along an imaginary line 50 that extends through the electron inlet port 39 and into the ion volume 38. The filaments 48 and 49 may be made of rhenium. Alternatively, the filaments 48 and 49 may optionally include tungsten, thoriated tungsten, thoriated tungsten rhenium, thoriated iridium, yttria coated rhenium, or any other suitable material. The filaments 48 and 49 may be disposed transverse to each other and have emission sections generally centered on the imaginary line 50. Alternatively, the filaments 48 and 49 may optionally include ribbon filaments, coil filaments, or combinations thereof.

The electron source 46 includes a filament supply 52. The filament supply 52 can selectively energize either one of the filaments 48 and 49 with a filament current. When energized, each filament 48 and 49 can emit a stream of electrons that propagates along the imaginary line 50 through the electron inlet port 39 to a target location 51, which may be a point or region within the ion volume 38. The filament supply 52 is controlled by an output 53 of the control system 22. Accordingly, the control system 22 can selectively turn each of the filaments 48 and 49 "on" and "off" and vary the filament current supplied by the filament supply 52, in a manner discussed later.

When energized, the filaments 48 and 49 are negatively biased with respect to the ion volume 38. The filament supply 52 includes an output 55 that is coupled to the ion volume 38 to create a difference in potential between the ion volume 38 and the filaments 48 and 49, thereby establishing the energy of electrons as they travel to the ion volume. The filament supply 52 also includes an output 54 coupled to the control system 22 that indicates to the control system when either of the filaments 48 and 49 is burned out.

The electron source 46 further includes an electron gate 56 of a known type. The electron gate 56 is provided between the filaments 48 and 49 and the electron inlet port 39. The electron gate 56 is controlled by an output 57 of the control system 22. The output 57 carries a signal having a duty cycle. The duty cycle determines the percentage of time that the gate is "open." The duty cycle may vary over a range from 0% to 100%. When the electron gate 56 is open, the stream of electrons flowing along line 50 propagates through the gate and into the ion volume 38. On the other hand, when the electron gate 56 is closed, it interrupts the stream of electrons, so that electrons are inhibited from traveling to and entering the ion volume 38. The duty cycle can be varied by using a fixed frequency and varying the pulse width, or by using a fixed pulse width and varying the frequency, or by varying both the frequency and pulse width. By varying the duty cycle, the quantity of electrons reaching the ion volume over time is varied and thus, the ions produced in the ion volume also vary. This approach is linear and predictable.

The electron source 46 further includes an electron lens 58 of a known type. For example, the electron lens 58 may include one or more lens(es) that can be operated in a focusing mode. The electron lens 58 may be part of the filament assembly 47. The electron lens 58 is controlled by an output 59 of the control system 22. The control system 22 includes an electron lens bias circuit that provides an electron lens voltage on output 59. The electron lens voltage positively biases the electron lens 58 with respect to the ion volume 38. The control system 22 can vary the electron lens voltage via the output 59, and thus can vary the focusing of the stream of electrons flowing toward the ion volume 38, in a manner discussed later. Even though the electron gate 56 and the electron lens 58 are described and shown here as separate components, they may alternatively be combined into a single component that provides both functionalities.

The electron source 46 further includes an electron emission sensor 60 for measuring an emission current of either filament 48 and 49 when energized with a filament current. The measured emission current can be transmitted to the control system 22 on line 62 for processing. The control system 22 can use the emission current information to control and set the filament current supplied from the filament supply 52, in a manner discussed later.

The ion source 12 includes a magnetic field generator 64. The magnetic field generator 64 includes a portion that generates a fixed magnetic field, such as permanent magnets, and a portion that generates a variable magnetic field, such as an electromagnet. The fixed and variable magnetic fields combine to produce a magnetic field that is aligned parallel with the imaginary line 50 to help keep the stream of electrons collimated. The magnetic field generator 64 is controlled by an output 66 of the control system 22. Accordingly, the control system 22 can selectively vary the strength of the magnetic field by a control signal sent on output 66, in a manner discussed later. Alternatively, the magnetic field generator 64 could include only permanent magnets for generating a magnetic field, and in that case there would be no output 66 for controlling the magnetic field generator. The ion source 12 further includes a set of lens elements 68 of a known type. The lens elements 68 are disposed between the ion volume 38 and the mass analyzer 14. The lens elements 68 are controlled by one or more outputs 70 of the control system 22.

In the discussed embodiment, the ion volume 38 is used for chemical ionization (CI). The general principles of CI are known in the art, and are therefore described only briefly here, and not in detail. During operation, the valve 42 remains open to allow a continuous flow of the reagent gas to pass through the conduit 41 and into the ion volume 38. As shown diagrammatically in FIG. 1, the ion volume 38 has only a few very small openings, including openings 39 and 40. Thus, due to these relatively small openings 39 and 40 and also the flow of reagent gas into the interior of the ion volume 38, the ion volume 38 is maintained at a relatively high pressure. The gas chromatograph 16 contains a sample material, and produces analytes of the sample material such as atoms or molecules thereof, which are supplied through the GC column 26 in a gas phase to the ion volume 38.

The control system 22 instructs the filament supply 52 to energize one of the filaments 48 and 49 with a filament current, and the energized filament emits a stream of electrons. The control system 22 controls the electron gate 56 with a signal having a duty cycle which determines the percentage of time the gate is "open." When the electron gate 56 is open and allows the stream of electrons to flow along line 50 to enter the ion volume 38, the electrons collide primarily with molecules of the high pressure reagent gas to form ions of the reagent gas. The stream of electrons is influenced by the electron lens voltage of the electron lens 58 and the magnetic field generated by the magnetic field generator 64 as previously discussed. When the electron gate 56 is closed, the stream of electrons is blocked and no electrons enter the ion volume 38.

The relatively high pressure within the ion volume 38 ensures a density of the reagent gas that promotes such collisions in order to produce ions of the reagent gas. The ions of the reagent gas then react with the analytes of the sample gas in order to form ions characteristic of the individual analytes. Gas flowing out of the ion volume 38 through the ion outlet port 40 carries with it these ions.

The control system 22 applies an electrical potential to the ion volume 38 through a control line 71, and also applies at least one electrical potential to the lens elements 68. The potential between the ion volume 38 and lens elements 68 extracts and focuses the ions of sample material generated within the volume 38. In particular, the ions travel along a path 72 from the ion volume 38, through the outlet 40, and through the lens elements 68 to the mass analyzer 14. The path 72 of ion travel is approximately perpendicular to the stream of electrons flowing along the line 50. The mass analyzer 14 scans across a range of mass-to-charge ratios (referred to as "mass") and can selectively filter out ions of a particular mass for detection by the detector 24. The detector 24 detects an ion intensity (quantity of ions) for that particular mass and generates an electrical signal corresponding to the detected ion intensity. The detected ion intensity information is sent on line 34 to the control system 22. The control system 22 executes a software program that processes the information and generates a mass spectrum of the sample material.

Even though the description above relates to a mass spectrometer operating by CI, the mass spectrometer 10 may alternatively be configured to operate by electron ionization (EI). In the case of EI, no reagent gas from source 18 is supplied to the ion volume 38, openings 39 and 40 may be made larger, and ions characteristic of the sample material are formed directly from interaction of the sample material with the electrons. Instead of using an electrically conductive housing for the ion volume 38, the ion volume that provides ion production could alternatively have some other configuration, such as an RF multipole trap or some other suitable ion trap.

The mass spectrometer 10 is operated using the filament 48 and under a selected set of operating parameters to determine an ion intensity produced from a sample analyte in the ion volume 38 in response to electrons from the filament 48. The sample analyte includes a known material, and thus predetermined ion intensities across a range of masses characteristic of the known material can be stored in memory 29 of the control system 22. Accordingly, the mass spectrometer 10 is evaluated with respect to the filament 48 to ensure that the mass spectrometer produces accurate and consistent data when running samples using the filament 48. The control system 22 then stores in memory 29 information relating to the ion intensity produced from operating using the filament 48 under the set of operating parameters.

The control system 22 turns the filament 48 "off" and turns the filament 49 "on" by sending a control signal on output 53 to the filament supply 52. The mass spectrometer 10 is operated using the filament 49 and under the same set of operating parameters used for the filament 48, to determine an ion intensity produced from the same sample analyte in the ion volume 38 in response to electrons from the filament 49. Information relating to the ion intensity produced from operating using the filament 49 under the same set of operating parameters is stored in memory 29 for later use when switching filaments.

Following the evaluation of the filaments 48 and 49, the mass spectrometer 10 can be operated to run samples of unknown materials. The control system 22 turns "on" the filament 48 and configures the mass spectrometer 10 to operate under the stored set of operating parameters associated with the filament 48. The mass spectrometer 10 generates a mass spectrum of each unknown material as previously discussed. The mass spectrometer 10 continues operating using the filament 48 until a problem is detected with the filament 48.

When a problem is detected with the filament 48 during a sample run, such as a filament burnout condition, the filament supply 52 indicates this to the control system 22. The control system 22 stops the current scan and notifies an operator of the problem. The operator can manually switch to, or the control system 22 can automatically switch to, the filament 49, begin the current scan again, and continue the sample run already in progress without recalibrating the mass spectrometer 10 with respect to the filament 49. The control system 22 executes a software program that uses the stored information to adjust one or more of the operating parameters so that the performance of the filament 49 after the switch is normalized relative to the performance of the filament 48 before the switch. That is, the ion intensity produced from operating using the filament 49 after the switch is substantially the same as the ion intensity produced from operating using the filament 48 before the switch. Thus, the mass spectrometer 10 is able to generate data that is accurate and consistent with data that was generated when operating using the filament 48, without recalibration.

As previously discussed, the control system 22 includes various outputs that control various components of the mass spectrometer 10. One of the parameters that can be adjusted is the duty cycle of the signal that controls the electron gate 56. The control system 22 can adjust the duty cycle to vary a rate of flow of electrons to the ion volume 38 and thus, vary the ion intensity produced in the ion volume. The relationship between the duty cycle and the ion intensity is substantially linear. Accordingly, the effect on the ion intensity can be easily predicted for any given change of the duty cycle. Using the stored information discussed earlier, the duty cycle can be accurately adjusted so that the ion intensity produced from operating using the filament 49 after the switch is consistent with the ion intensity produced from operating using the filament 48 before the switch. Thus, the mass spectrometer 10 can be operated using the filament 49 to continue the sample run already in progress. Using this approach, and if the filament change is carried out automatically, the switch from operation using one filament to operation using the other filament can take as little as two or three seconds.

In the disclosed embodiment, the duty cycle used for the electron gate 56 varies across the range of masses, in order to achieve proper tuning of the mass spectrometer 10 (i.e., proper detection of ions having various different masses). In more detail, the overall range of masses is divided into several different mass ranges, and the duty cycle used for each mass range may be different than the duty cycle used for the other mass ranges. In operation, the mass analyzer 14 scans for ions across the range of masses, from low to high or high to low, for detection by the detector 24. The mass analyzer changes the duty cycle used for the electron gate 56 as it moves from each mass range to the next mass range. A waveform or profile representing a relationship between duty cycle and mass ranges can be determined, and stored in the memory 29. When the system is evaluating the filament 48 and the filament 49, the information that it saves for each filament includes information specific to each of the mass ranges. Then, when the system needs to switch from the filament 48 to the filament 49, normalization can be effected independently for each of the mass ranges, so that ion production in each mass range immediately after the switch is equivalent to ion production in that mass range immediately before the switch.

For purposes of the foregoing discussion, it has been assumed that the filament 49 is capable of performance equivalent to the performance of the filament 48. As a practical matter, however, there may be situations in which the filament 48 is capable of a level of performance that exceeds the maximum performance of the filament 49, such that adjusting the duty cycle for the filament 49 to a maximum value (i.e., 100%) is not sufficient to normalize the performance of filament 49 relative to the performance of filament 48. In other words, the maximum ion intensity that can be produced by the filament 49 may be lower than the maximum ion intensity produced by the filament 48. Accordingly, where the initial evaluation of the two filaments reveals this type of situation, the mass spectrometer 10 may establish the control for filament 48 so that it does not produce an ion intensity beyond that which the filament 49 is capable of producing.

The ion intensity produced while operating with the filament 48 may change over time as the filament ages and/or the ion source 12 develops deposits from previous sample runs. Also, the ion intensity that would be produced from operating with the filament 49 may change due to the change in operating conditions. Therefore, the relative performances of the filaments 48 and 49 are periodically measured, and the stored information associated with the filaments is updated in memory 29. The updated information compensates for a change over time in the operating conditions of the mass spectrometer 10. These periodic measurements can be performed during periodic automatic tunes of the mass spectrometer 10. Alternatively, the measurements can be performed from time to time before a chromatographic run, by looking at an ion intensity such as a background ion intensity. Accordingly, when subsequently switching filaments, the control system 22 uses stored information that represents the most recently measured relative performances of the filament 48 and filament 49.

Potential problems with either filament 48 or 49 may be detected while periodically evaluating the performance of one or both filaments. For example, as performance of the filament 48 degrades over time, the amount of filament current needed to generate the same level of emission current will change. The filament may reach a point where it is clear that a burnout condition will soon occur. For example, the measured performance of the filament 48 may show a large change in comparison to its previous measured performance. In response to detection of such a condition, the control system 22 may switch from filament 48 to filament 49 at that point, before filament 48 fails. Alternatively, the control system 22 may notify an operator of the mass spectrometer 10 of the potential problem. The operator can then elect to switch filaments at that point and continue operation with the "good" filament 49, and soon after that the "bad" filament 48 can be serviced or replaced during regularly scheduled maintenance. Alternatively, the operator may elect to replace the "bad" filament 48 with a "new" filament at the earliest convenient opportunity. Following such replacement, the mass spectrometer would evaluate the relative performances of the "new" filament and the "good" filament 49, and store information that it can later use for normalization when switching filaments.

Figure 2:
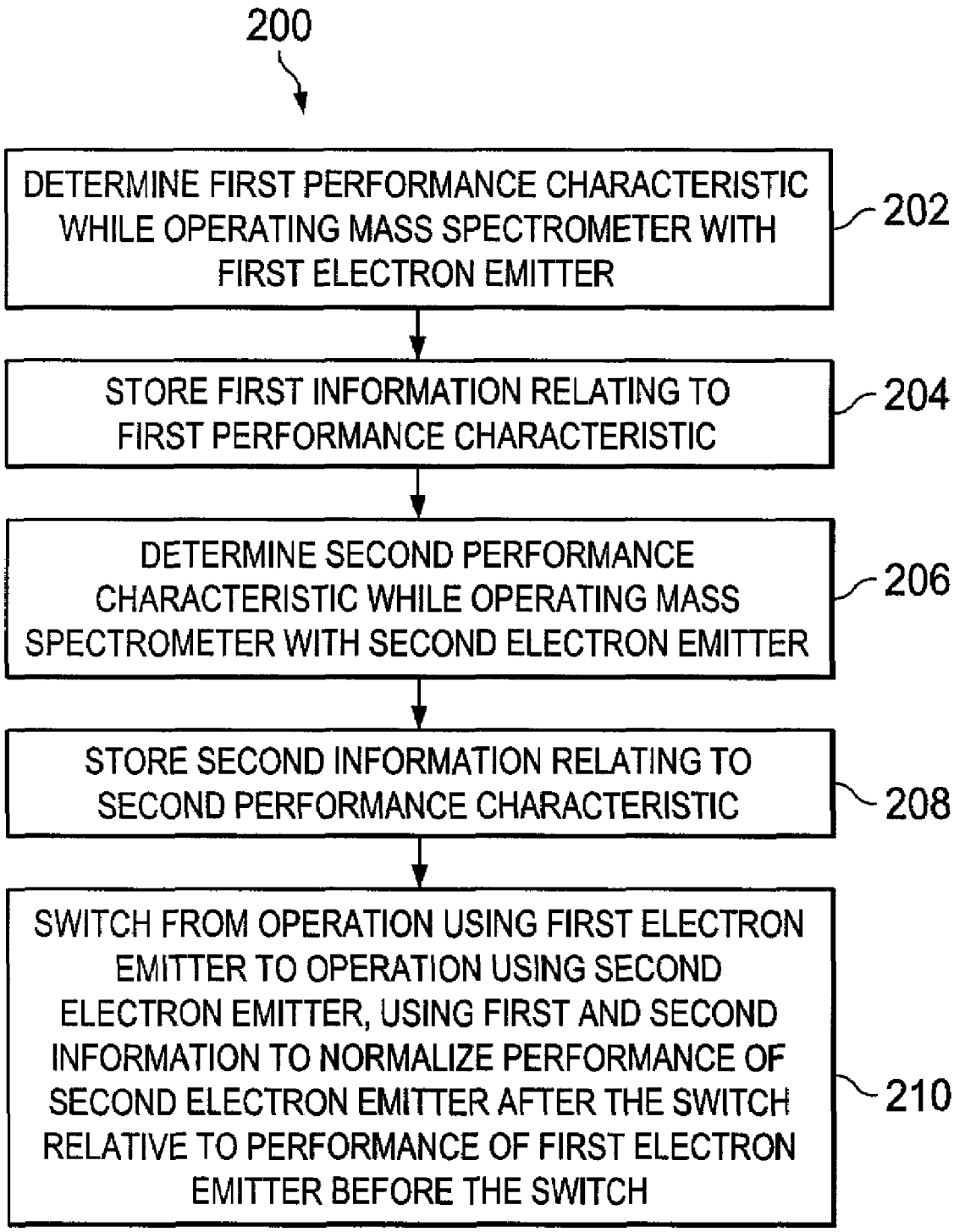
FIG. 2 is flowchart of a method of operating the mass spectrometer of FIG. 1.

FIG. 2 is a flowchart showing at 200 the above-described method for operating the mass spectrometer 10 of FIG. 1. The method 200 begins with block 202 in which a first performance characteristic (such as ion intensity) is determined while operating the mass spectrometer 10 with a first electron emitter (such as filament 48). The method 200 continues with block 204, in which first information (such as the ion intensity produced from operating with the filament 48 under a specific set of operating parameters) is stored in relation to the first performance characteristic.

The method 200 continues with block 206, in which a second performance characteristic (such as ion intensity) is determined while operating the mass spectrometer 10 with a second electron emitter (such as filament 49) under the same operating parameters used for the first electron emitter. The method continues with block 208, in which second information (such as the ion intensity produced from operating with the filament 49 under the same set of operating parameters) is stored in relation to the second performance characteristic. The method 200 continues with block 210, in which a switch is made from operation using the first electron emitter to operation using the second electron emitter. The switch includes using the first information and second information to normalize performance of the second electron emitter after the switching relative to performance of the first electron emitter (such as adjusting an operating parameter that specifies the duty cycle for the gate 56).

In an alternative embodiment, the operating parameter that is adjusted can be the emission current of the filament instead of the duty cycle for the electron gate 56. As previously discussed, the control system 22 includes an output 53 that controls the filament supply 52 which supplies a filament current to the active filament (the filament that is turned "on"). When energized with the filament current, the filament emits electrons at a rate that is called the emission current. The emission current is measured by the sensor 60 and the information is sent to the control system 22. The control system 22 can adjust the filament current to vary the emission current, and thus vary the rate of flow of electrons to the ion volume 38. Accordingly, the ion intensity produced in the ion volume is varied as well. The relationship between the filament current and emission current is non-linear, and thus the relationship between filament current and ion intensity is also non-linear. Consequently, to achieve a desired ion intensity, an iterative process of adjusting the filament current may need to be performed in order to obtain and maintain an appropriate emission current and thus an appropriate level of ion production.

In another embodiment, the operating parameter that is adjusted is the electron lens voltage of the electron lens 58 instead of the duty cycle for the electron gate 56. As previously discussed, the electron lens 58 is controlled by an output 59 of the control system 22. The electron lens 58 is positively biased with respect to the ion volume 38 to adjustably focus the flow of emitted electrons toward the ion volume 38. The control system 22 can adjust the electron lens voltage to vary the direction of travel of the electrons and thus the percentage of emitted electrons that reach the ion volume 38, which in turn varies the ion intensity produced in the ion volume. The relationship between the electron lens voltage and the ion intensity is non-linear. Thus, an iterative process of adjusting the electron lens voltage to achieve a desired ion intensity may be performed.

In another embodiment, the operating parameter that is adjusted is the magnetic field generated by the magnetic field generator 64 instead of the duty cycle for the electron gate 56. As previously discussed, the control system 22 includes an output 66 that controls the magnetic field generator 64. The magnetic field influences the degree of collimation of the stream of electrons flowing toward the ion volume 38. The control system 22 can adjust the magnetic field to vary a percentage of emitted electrons that reach the ion volume 38, and thus vary the ion intensity produced in the ion volume. The relationship between the magnetic field and the ion intensity is non-linear. Thus, an iterative process of adjusting the magnetic field to achieve a desired ion intensity may be performed.

In yet another embodiment, the operating parameter that is adjusted is the gain of the detector 24 instead of the duty cycle for the electron gate 56. As previously discussed, the detector 24 has a gain that varies in response to a gain control signal sent from the control system 22. Accordingly, the control system 22 can adjust the gain of the detector 24, and thus vary the detected value of ion intensity. The relationship between the gain control signal and the gain of the detector 24 is specified by a predetermined gain curve for the detector 24. Thus, the gain can be accurately adjusted according to the gain curve to achieve a desired detected value of the ion intensity.

In an alternative embodiment, the operating parameter that is adjusted is a scaling factor used by the DSP 28 to scale the data received from the mass analyzer 14 and detector 24. As previously discussed, the control system 22 includes a software program that processes data from the detector 24. The data includes a value that represents an ion intensity detected by the detector 24. The control system 22 receives and processes this data to generate a mass spectrum of the sample material. The software program includes a scaling factor that is used to scale the data from the detector 24. Accordingly, the control system 24 can adjust the scaling factor, and thus vary the value of detected ion intensity. Adjustment of the scaling factor produces a linear effect on the ion intensity value.

Even though the embodiments above each use one operating parameter to normalize the ion intensity when switching filaments, it is understood that various combinations of the operating parameters could alternatively be used to achieve similar results. For example, it has been contemplated that the duty cycle for the electron gate and the gain of the detector could be adjusted in combination to achieve the desired ion intensity. In addition, each of the various operating parameters may be mass dependent, or in other words have different values in different ranges of masses, as described above for the duty cycle of the electron gate. Therefore, any given operating parameter may be adjusted independently for each mass range, in order to achieve normalization of ion intensities produced across the entire mass range when switching filaments. Further, other performance characteristics may be used to normalize the performance of the filaments. For example, the electron emission characteristic of the filaments may be used to determine the rate of flow of electrons to the ion volume. Accordingly, one or more operating parameters can be adjusted so the rate of flow of electrons from operating with either filament results in the same level of ion production, and thus the operation of the mass spectrometer produces accurate and consistent data without recalibration when switching filaments.

Also, a normalization factor could be determined each time the relative performances of the filaments are measured. The normalization factor would represent an adjustment factor (of one of the operating parameters) that is required to normalize the performance of one filament relative to the performance of the other filament. Accordingly, the control system could use this normalization factor to adjust one or more of the operating parameters when switching filaments.

Although several embodiments have been illustrated and described in detail, it will be understood that a variety of substitutions and alterations are possible without departing from the spirit and scope of the present invention, as defined by the following claims. For example, it is to be understood that, in place of the two-filament configuration shown and described above, the disclosed methods may be implemented with ion sources having more than two filaments. That is, three, four, five, or any number of filaments could be placed adjacent to each other to provide redundancy when an active filament burns out, each of the filaments being evaluated and parameters stored so that the ion intensity can remain substantially the same for each filament. Further, the filaments may be different from each other, such as one having a hairpin configuration and the other having a coil configuration, or one filament being rhenium and the other being tungsten.

In addition, the methods described above may be implemented in mass spectrometers that have filaments disposed on opposite sides of the ion volume, instead of two filaments disposed on the same side of the ion volume as shown and described above. For example, there may be additional filament assemblies and supplies, electron gates, electron lens(es), electron inlet ports, and other components. The control system would be configured to control the respective components for each filament to achieve the same results as described above.

What is claimed is:

1. A method for operating a mass spectrometer having first and second electron emitters, the method comprising:

determining a first performance characteristic while operating the mass spectrometer with the first electron emitter;

storing first information relating to the first performance characteristic;

determining a second performance characteristic while operating the mass spectrometer with the second electron emitter;

storing second information relating to the second performance characteristic; and thereafter switching from operation using the first electron emitter to operation using the second electron emitter, wherein the switching includes using the first and second information to normalize performance of the second electron emitter after the switching relative to performance of the first electron emitter before the switching.

2. A method according to claim 1, wherein the mass spectrometer includes an ion volume, the first and second electron emitters being disposed to supply electrons to the ion volume;

wherein the determining the first performance characteristic includes determining a first ion intensity produced from a material in the ion volume in response to electrons from the first electron emitter while the mass spectrometer is operating under a first operating parameter;

wherein the storing first information includes storing information associated with a relationship between the first ion intensity and the first operating parameter;

wherein the determining the second performance characteristic includes determining a second ion intensity produced with the material in the ion volume in response to electrons from the second electron emitter while the mass spectrometer is operating under a second operating parameter; and wherein the storing second information includes storing information associated with a relationship between the second ion intensity and the second operating parameter.

3. A method according to claim 2, wherein the mass spectrometer includes a gate portion that varies a flow of electrons from the first electron emitter to the ion volume in response to-variation of a duty cycle of a first signal, and that varies a flow of electrons from the second electron emitter to the ion volume in response to variation of a duty cycle of a second signal;

including configuring the first operating parameter to specify the duty cycle of the first signal; and including configuring the second operating parameter to specify the duty cycle of the second signal.

4. A method according to claim 3, including:

analyzing ions across a range of mass-to-charge ratios that includes a first mass-to-charge ratio, and a second mass-to-charge ratio different from the first mass-to-charge ratio;

setting the duty cycle of the first signal to a first value when the mass analyzer is analyzing ions having the first mass-to-charge ratio and to a second value different from the first value when the mass analyzer is analyzing ions having the second mass-to-charge ratio; and setting the duty cycle of the second signal to a third value when the mass analyzer is analyzing ions having the first mass-to-charge ratio and to a fourth value different from the third value when the mass analyzer is analyzing ions having the second mass-to-charge ratio.

5. A method according to claim 2, wherein the first and second electron emitters respectively include first and second filaments;

wherein the mass spectrometer includes a power supply for selectively supplying a first filament current to the first filament, and for selectively supplying a second filament current to the second filament;

including configuring the first operating parameter to specify the first filament current; and including configuring the second operating parameter to specify the second filament current.

6. A method according to claim 2, wherein the mass spectrometer includes an electron lens portion for selectively focusing electrons from the first electron emitter into the ion volume in response to a first signal, and for selectively focusing electrons from the second electron emitter into the ion volume in response to a second signal;

including configuring the first operating parameter to specify the first signal; and including configuring the second operating parameter to specify the second signal.

7. A method according to claim 2, wherein the mass spectrometer includes a magnetic field generator responsive to a first signal for generating a magnetic field that influences a flow of the electrons from the first electron emitter to the ion volume, and responsive to a second signal for generating a magnetic field that influences a flow of the electrons from the second electron emitter to the ion volume;

including configuring the first operating parameter to specify the first signal; and including configuring the second operating parameter to specify the second signal.

8. A method according to claim 2, wherein the mass spectrometer includes a detector for detecting the ion intensity produced in the ion volume, the detector having a gain that varies in response to a gain control voltage;

including configuring the first operating parameter to specify the gain control voltage used during the determining the first performance characteristic; and including configuring the second operating parameter to specify the gain control voltage used during the determining the second performance characteristic.

9. A method according to claim 2, including detecting an intensity of ions from the ion volume;

wherein the mass spectrometer includes a digital processor that uses a scaling factor to scale the detected ion intensities;

including configuring the first operating parameter to specify the scaling factor used during the determining of the first performance characteristic; and including configuring the second operating parameter to specify the scaling factor used during the determining of the second performance characteristic.

10. A method according to claim 1, further comprising:

determining a change over time in the first performance characteristic caused by operating the mass spectrometer with the first electron emitter; and updating one of the first information and the second information in a manner that compensates for the change.

11. A method according to claim 10, wherein the updating is performed on both the first information and the second information.

12. A method according to claim 10, wherein the determining the change is performed during a tuning process that evaluates whether the mass spectrometer is operating within acceptable limits of a standard.

13. A method according to claim 10, wherein the determining the change is performed before conducting a chromatographic run by analyzing a background ion intensity of the mass spectrometer.

14. A method according to claim 1, wherein the mass spectrometer includes an ion volume, the first and second electron emitters being disposed to supply electrons to the ion volume; and wherein the switching includes normalizing the performance of the second electron emitter such that a rate of flow of electrons from the second electron emitter into the ion volume while in operation immediately after the switching results in substantially the same level of ion production as that resulting from a rate of flow of electrons from the first electron emitter into the ion volume while in operation immediately before the switching.

15. A method according to claim 1, wherein the switching occurs without recalibrating the mass spectrometer with respect to the second electron emitter.

16. A method according to claim 1, further comprising:

detecting a problem with the first electron emitter;

wherein the switching occurs when the problem has been detected.

17. An apparatus comprising a mass spectrometer that includes:

structure defining an ion volume;

first and second electron emitters that can each selectively supply electrons to the ion volume; and a controller configured to:

determine a first performance characteristic while operating the mass spectrometer with the first electron emitter;

store first information relating to the first performance characteristic;

determine a second performance characteristic while operating the mass spectrometer with the second electron emitter;

store second information relating to the second performance characteristic; and thereafter switch from operation using the first electron emitter to operation using the second electron emitter, including use of the first and second information to normalize performance of the second electron emitter after the switch relative to performance of the first electron emitter before the switch.

18. An apparatus according to claim 17, wherein the first performance characteristic includes a first ion intensity produced with a material in the ion volume in response to electrons from the first electron emitter while the mass spectrometer is operating under a first operating parameter;

wherein the first information includes information associated with a relationship between the first ion intensity and the first operating parameter;

wherein the second performance characteristic includes a second ion intensity produced with the material in the ion volume in response to electrons from the second electron emitter while the mass spectrometer is operating under a second operating parameter; and wherein the second information includes information associated with a relationship between the second ion intensity and the second operating parameter.

19. An apparatus according to claim 18, wherein the mass spectrometer includes a gate portion that varies a flow of electrons from the first electron emitter to the ion volume in response to variation of a duty cycle of a first signal, and that varies a flow of electrons from the second electron emitter to the ion volume in response to variation of a duty cycle of a second signal;

wherein the first operating parameter specifies the duty cycle of the first signal; and wherein the second operating parameter specifies the duty cycle of the second signal.

20. An apparatus according to claim 19, wherein the mass spectrometer includes a mass analyzer for analyzing ions across a range of mass-to-charge ratios that includes a first mass-to-charge ratio, and a second mass-to-charge ratio different from the first mass to charge ratio;

wherein the duty cycle of the first signal is a first value when the mass analyzer is analyzing ions having the first mass-to-charge ratio and a second value different from the first value when the mass analyzer is analyzing ions having the second mass-to-charge ratio; and wherein the duty cycle of the second signal is a third value when the mass analyzer is analyzing ions having the first mass-to-charge ratio and a fourth value different from the third value when the mass analyzer is analyzing ions having the second mass-to-charge ratio.

21. An apparatus according to claim 17, wherein the controller is configured to:

determine a change over time in the first performance characteristic caused by operating the mass spectrometer with the first electron emitter; and update one of the first information and the second information in a manner that compensates for the change.

22. An apparatus according to claim 21, wherein the controller is configured to carry out the update in a manner that includes updating both the first information and the second information.

* * * * *